US010081516B2

(12) United States Patent
Pelto-Huikko

(10) Patent No.: US 10,081,516 B2
(45) Date of Patent: Sep. 25, 2018

(54) ROPE TERMINAL ASSEMBLY AND AN ELEVATOR

(71) Applicant: Raimo Pelto-Huikko, Vantaa (FI)

(72) Inventor: Raimo Pelto-Huikko, Vantaa (FI)

(73) Assignee: Kone Corporation, Helsinki (FI)

( * ) Notice: Subject to any disclaimer, the term of this patent is extended or adjusted under 35 U.S.C. 154(b) by 122 days.

(21) Appl. No.: 15/056,096

(22) Filed: Feb. 29, 2016

(65) Prior Publication Data

US 2016/0207739 A1 Jul. 21, 2016

Related U.S. Application Data

(63) Continuation of application No. PCT/FI2014/050682, filed on Sep. 8, 2014.

(30) Foreign Application Priority Data

Sep. 24, 2013 (EP) ..... 13185681

(51) Int. Cl.
*B66B 7/08* (2006.01)
*B66B 9/00* (2006.01)

(52) U.S. Cl.
CPC ..... *B66B 7/085* (2013.01); *B66B 9/00* (2013.01)

(58) Field of Classification Search
CPC ..... B66B 7/1223; B66B 7/085; B66B 9/00
See application file for complete search history.

(56) References Cited

U.S. PATENT DOCUMENTS 4,845,814 A * 7/1989 Crook ..... F16G 11/048 24/135 R
7,607,204 B2 * 10/2009 Ach ..... B66B 7/085 187/411
7,681,934 B2 * 3/2010 Harada ..... B66C 1/12 294/74

(Continued)

FOREIGN PATENT DOCUMENTS

DE 3934654 A1 * 5/1991 ..... B66B 7/1223
DE 202007004017 U1 5/2007

(Continued)

OTHER PUBLICATIONS

EPO Machine Translation, WO 2009003815, Aug. 21, 2017, pp. 1-11.*

(Continued)

*Primary Examiner* — Michael A Riegelman
(74) *Attorney, Agent, or Firm* — Harness, Dickey & Pierce, P.L.C.

(57) ABSTRACT

The invention relates to a rope terminal assembly of an elevator fixing an elevator rope to a fixing base such as an elevator unit, said elevator being suitable for transporting passengers and/or goods, which assembly comprises, an elevator rope, whose width is larger than its thickness in a rope transverse direction, with at least one end having an end face, one or more wedge elements, a wedge housing, the rope terminal assembly comprising a rope gap through which said elevator rope passes and said wedge element is arranged to wedge between said rope and said wedge housing thus locking said elevator rope in the gap, and said wedge housing is a one piece structure of predetermined size made from a hollow tube, and an elevator.

15 Claims, 5 Drawing Sheets

(56) References Cited

U.S. PATENT DOCUMENTS

| | | | | |
|---|---|---|---|---|
| 8,011,479 | B2 * | 9/2011 | Stucky | B66B 7/1223 187/391 |
| 2001/0040039 | A1 * | 11/2001 | De Angelis | B66B 7/1223 174/74 R |
| 2002/0042973 | A1 * | 4/2002 | Rivera | B66B 7/085 24/115 R |
| 2002/0194935 | A1 * | 12/2002 | Clarke | G01L 1/205 73/862.046 |
| 2011/0000746 | A1 * | 1/2011 | Pelto-Huikko | B66B 7/062 187/254 |
| 2011/0220438 | A1 * | 9/2011 | Annen | B66B 7/062 187/251 |
| 2013/0062146 | A1 | 3/2013 | Nolting et al. | |
| 2014/0182975 | A1 * | 7/2014 | Ikonen | B66B 5/0031 187/251 |
| 2014/0305744 | A1 * | 10/2014 | Kere | B66B 7/1238 187/254 |
| 2015/0101889 | A1 * | 4/2015 | Kere | B66B 7/085 187/254 |
| 2015/0151948 | A1 * | 6/2015 | Pelto-Huikko | B66B 9/00 187/254 |
| 2015/0307323 | A1 * | 10/2015 | Zapf | B66B 7/062 187/411 |
| 2016/0185572 | A1 * | 6/2016 | Lehtinen | B66B 7/085 187/411 |
| 2016/0207739 | A1 * | 7/2016 | Pelto-Huikko | B66B 9/00 |

FOREIGN PATENT DOCUMENTS

| | | | | |
|---|---|---|---|---|
| EP | 2020399 | A1 | 2/2009 | |
| EP | 2371753 | A1 | 10/2011 | |
| FI | 20126393 | * | 12/2012 | |
| FR | 2630516 | A1 | 10/1989 | |
| JP | S49128163 | A | 12/1974 | |
| JP | S63139338 | U | 9/1988 | |
| JP | 2009298518 | A * | 12/2009 | B66B 7/08 |
| WO | WO 2009003815 | A1 * | 1/2009 | B66B 7/085 |
| WO | WO-2009109060 | A1 | 9/2009 | |
| WO | WO-2011098847 | A1 | 8/2011 | |

OTHER PUBLICATIONS

AIPN Machine Translation, JP 2009-298518 A, Aug. 19, 2017, pp. 1-12.*

European Search Report for Application No. EP13185681 Dated Feb. 3, 2014.

International Search Report PCT/ISA/210 for International Application No. PCT/FI2014/050682 Dated Dec. 31, 2014.

Written Opinion of the International Searching Authority PCT/ISA/237 for International Application No. PCT/FI2014/050682 Dated Dec. 31, 2014.

Chinese Office Action dated Feb. 4, 2017 issued in corresponding Chinese Application No. 201480052280.9 (no English translation).

* cited by examiner 6
7a
7b
7b'
6'
7c
7c'
7c''
7c'''
7c''''

10
1
7a''''
R'
9
7a'''
7a''
8
8'

9
91
81
7a'
7
8
8'
R
7a
R

ROPE TERMINAL ASSEMBLY AND AN ELEVATOR

This application is a continuation of PCT International Application No. PCT/FI2014/050682 which has an International filing date of Sep. 8, 2014, and which claims priority to European patent application number 13185681.7 filed Sep. 24, 2013, the entire contents of both of which are incorporated herein by reference.

FIELD OF THE INVENTION

The object of the invention is a rope terminal assembly of an elevator, the elevator being suitable for transporting passengers and/or goods, and an elevator.

BACKGROUND OF THE INVENTION

In elevator systems, elevator roping is used for suspending and/or moving an elevator car, a counterweight or both. In modern elevators lightweight suspension roping is used, where the elevator roping comprises plural belt-type ropes where the width of the rope is larger than its thickness in a transverse direction of the rope. The rope comprises a load-bearing part made of composite materials, which composite materials comprise non-metallic reinforcing fibers in polymer matrix material. The structure and choice of material make it possible to achieve low-weight elevator ropes having a thin construction in the bending direction, a good tensile stiffness and tensile strength in longitudinal direction. In addition, the rope structure remains substantially unchanged at bending, which contributes towards a long service life.

Several arrangements have been presented to provide tools for attaching elevator ropes with the elevator units. With non-metallic elevator ropes, particularly with elevator ropes made of fiber-reinforced polymer composite materials, it is challenging to make mechanical attachment with the elevator unit without causing damage in the elevator rope. Using a wedge element and a wedge housing with welded joints have been successfully used in rope terminal assembly to lock the elevator rope in its rope terminal. The drawback of this kind of elevator rope terminal assembly is that it requires a complicated rope terminal wedge housing with several elements joined together by welding. The complicated geometry of the wedge housing with welded joints is not optimal from strength of material point of view. Furthermore, the elevator roping typically comprises plural ropes, which makes the number of rope terminals needed numerous and hence the production of large amounts of complicated rope terminal products, especially on assembly lines costly. It would be advantageous if the elevator rope terminal could be formed as simple as possible with seamless wedge housing without multiple elements welded together. There is thus a growing need for cost effective and reliable elevator rope terminal assembly with a connection to the rope condition monitoring means of an elevator.

BRIEF DESCRIPTION OF THE INVENTION

The object of the invention is to introduce an improved rope terminal assembly and an elevator. The object of the invention is, inter alia, to solve drawbacks of known solutions and problems discussed later in the description of the invention. It is also an object to allow a cost-effective and reliable rope terminal assembly with faster manufacturing and installation process. The object of the invention is to provide rope terminal assembly with improved quality of manufacturing and installation for the elevator ropes comprising polymer composite materials.

Embodiments are presented which, inter alia, facilitate simple, safe and efficient rope terminal manufacturing process and rope terminal assembly with connection to damage detection of non-metallic load bearing parts in said elevator ropes. Also, embodiments are presented, where rope terminal assembly enables the production of large amounts of rope terminal products, especially on assembly lines of rope terminals in a cost-effective way.

It is brought forward a new rope terminal assembly of an elevator fixing an elevator rope to a fixing base such as an elevator unit, said elevator being suitable for transporting passengers and/or goods, which assembly comprises an elevator rope, whose width is larger than its thickness in a rope transverse direction, with at least one end having an end face, one or more wedge elements, and a wedge housing. The rope terminal assembly comprises a rope gap through which said elevator rope passes and said wedge element is arranged to wedge between said rope and said wedge housing thus locking said elevator rope in the gap. The wedge housing is a one piece structure of predetermined size.

In a preferred embodiment, said wedge housing is a one piece structure of predetermined size made from a hollow tube of round cross-section. To hydroform a metallic, preferably aluminum hollow tube into the wedge housing shape, a hollow tube of preferably ductile metal such as aluminum, brass, low alloy steels, stainless steel is placed inside a negative mold that has the shape of the wedge housing. High pressure hydraulic pumps are then used to inject fluid at very high pressure inside the aluminum which causes it to expand until it matches the mold. The hydroformed aluminum wedge housing is then removed from the mold. Hydroforming allows complex shapes with concavities to be formed, which would be difficult or impossible with standard solid die stamping. Hydroformed wedge housing can hence be made with a higher stiffness-to-weight ratio and at a lower per unit cost than traditional stamped or stamped and welded wedge housing.

In a preferred embodiment, said wedge housing is a one piece structure of predetermined size made from a hollow tube by tube hydroforming, preferably by bulge forming method. In this way, shaping rope terminal wedge housing into lightweight, structurally stiff and strong pieces is carried out in a cost-effective way.

In a preferred embodiment, said elevator roping comprises at least one rope comprising at least one load-bearing member made from carbon-fiber-reinforced polymer composite material. In a preferred embodiment, each of said at least one load bearing member has width greater than thickness thereof in the width-direction of the rope. In particular, it is preferable that each of said at least one rope is in the form of a belt. Large width makes it well suitable for elevator use as bending of the rope is necessary in most elevators. The rope, in particular the load bearing member(s) thereof, can in this way be given a large cross-sectional area, which facilitates feasible dimensioning of the stiffness of the roping.

In a preferred embodiment, said rope terminal assembly comprises a rope end block attached to said rope end, and said rope end block is attached on said end face side of the elevator rope with respect to the wedge element. Hence also safety of the rope terminal assembly is improved. Said rope end block is used as safety means for the rope terminal assembly. If the elevator rope slips in the rope gap of said rope terminal assembly, the rope end block pushes the wedge element such that the wedge element is arranged to wedge more tightly between said rope and said wedge housing thus locking said elevator rope in the gap.

In a preferred embodiment, said wedge element is an elongated element comprising a smooth contact surface portion and a rough or patterned contact surface portion, said smooth contact surface portion is arranged against said wedge housing element and said rough or patterned contact surface is arranged against said elevator rope surface. The wedge element also comprises a space for the rope end block at the first end of the wedge element. It is thus possible for the fastening means of the rope end block to be attached to the space of the wedge element. The space for the rope end block is advantageously on the rough or patterned contact surface portion side of the first end of the wedge element and comprises a threaded opening for the fastening means. The wedge element is advantageously made of metal or of some other mechanically suitable material.

In a preferred embodiment, said elevator rope is electrically connected to a rope condition monitoring means via said rope end block comprising one or more electrically conductive short circuit elements and fastening means. In a preferred embodiment, elevator ropes with carbon-fiber-reinforced polymer composite load bearing parts are fixed to the elevator unit with said rope terminal assembly and electrical rope condition monitoring means are connected to the rope via said rope end block of the rope terminal assembly. For unidirectional carbon-fiber-reinforced polymer composites, the longitudinal electrical resistance of unidirectional fiber is much lower than the transverse resistance, and the damage in the composite material can be detected by measuring the one or the other. Electrical resistance is a good damage sensor for carbon/epoxy laminates, especially for the detection of fiber breakage.

In a preferred embodiment, the rope terminal assembly is used in elevators with counterweight, however as well being applicable in elevators without counterweight. In addition, it can also be used in conjunction with other hoisting machines, e.g. as a crane suspension and/or transmission rope. The low weight of the rope provides an advantage especially in acceleration situations, because the energy required by changes in the speed of the rope depends on its mass. The low weight further provides an advantage in rope systems requiring separate compensating ropes, because the need for compensating ropes is reduced or eliminated altogether. The low weight also allows easier handling of the ropes.

In a preferred embodiment of an elevator, said rope terminal assembly according to the invention is used to fix an elevator rope to a fixing base such as the elevator unit or the end of a hoistway. The elevator has been arranged to comprise a hoistway, and an elevator unit movable in the hoistway, the elevator unit being an elevator car for transporting passengers and/or goods. The elevator arrangement may also comprise other movable elevator units such as the counterweight, as depicted. The elevator comprises lifting means comprising a lifting device, one or more suspension and/or transmission ropes, each said rope comprising one or more, preferably at least four load bearing parts, attached with the rope terminal assembly at least to one elevator unit. In a preferred embodiment each rope is guided to pass over the traction sheave rotated by the hoisting machine of the elevator and one ore more diverting pulleys. As the hoisting machine rotates, the traction sheave at the same time moves the elevator car and the counterweight in the up direction and down direction, respectively, due to friction. In addition, in high-rise buildings and in high-speed elevators there are one or more compensating ropes, each compensating rope being attached at its first end to the bottom end of the counterweight and at its second end to the bottom part of the elevator car, either to the car sling or to the car itself. The compensating rope is kept taut, e.g. by means of compensating pulleys, under which the compensating rope passes around and which pulleys are supported to a support structure on the base of the elevator hoistway. A travelling cable intended for the electricity supply of the elevator car and/or for data traffic, is attached at its first end to the elevator car, e.g. to the bottom part of the elevator car, and at its second end to a connection point on the wall of the elevator hoistway, which connection point is typically at the point of the midpoint or above the midpoint of the height direction of the elevator hoistway.

Preferably the elevator comprises rope condition monitoring means comprising an elevator rope electrically connected to a rope condition monitoring means via said rope end block comprising one or more electrically conductive short circuit elements and fastening means, a rope condition monitoring device, which monitors and transmits an electrical signal of said elevator rope, at predefined time intervals, preferably at least once per second, to an elevator controller. If an error signal is transmitted from said rope condition monitoring means to an elevator controller, the elevator operation is altered or the elevator is taken out of service. Preferably the rope condition monitoring means comprise a current source, a voltage measurement device, a microcontroller, and a display for monitoring condition of said ropes.

In a preferred embodiment, the rope end block has first part on a first side of said elevator rope and a second part on a second side of said elevator rope. Preferably the rope end block extends over said end face of said elevator rope and is a single piece structure where said first part and a second part of said rope end block are connected with a middle part of said rope end block.

Preferably rope end block is manufactured from plastics or some other electrically non-conductive material. Preferably rope end block is a single piece structure manufactured from plastics, preferably from thermoplastics polymer, for instance polyethylene, polypropylene, polystyrene or polyvinyl chloride, or thermosetting polymer, for instance polyester, polyurethanes or epoxy resins. The rope end block may be reinforced by glass, carbon or aramid fibers, and the reinforcing fibers may by short cut or they may be continuous fibers. Hence the mechanical properties, particularly specific strength and stiffness of the rope end block are improved. The rope end block is preferably manufactured by extrusion, pultrusion, injection molding, blow molding, thermoforming, rotational molding, casting, foaming, compression molding or transfer molding, for instance. Thus the manufacturing of rope end block pieces is fast and the manufacturing costs are lower. Said rope end block pieces may also be manufactured from re-cycled plastics or other re-cycled materials.

Preferably the rope end block comprises a first frame portion attached to said elevator rope end and a second frame portion attached to said wedge element. Preferably but not necessary rope end block comprises an elastic portion between said first and second frame portions which elastic portion allows relative movement of said first and second frame portions of said rope end block. Said elastic portion is advantageously located outside of the second frame portion of said rope end block attached to said wedge element.

Preferably rope end block is attached to said elevator rope end with fastening means. It is thus possible for the fastening means to pass through the openings in the first frame portion of the rope end block. The fastening means can advantageously be made of metal or of some other suitable electrically conductive material. The fastening means are advantageously screws or bolts with nuts. Fastening to the rope can be done by drilling bores in the rope and fastening with screws or bolts. Elasticity of said rope end block can also be arranged by sizing and designing the openings of the first frame portion of the rope end block to have an oval shape, for instance.

Preferably rope end block is attached to a wedge element with fastening means. It is thus possible for the fastening means to pass through the openings in the second frame portion of the rope end block. The fastening means can advantageously be made of metal or of some other mechanically suitable material. The fastening means are advantageously screws or bolts. The fastening to the wedge element can be done by drilling bores in the wedge element and fastening with screws or bolts.

Preferably rope end block comprises one or more short circuit elements attached to said rope end block with fastening means. It is thus possible for the fastening means to pass through the openings in the short circuit elements. The short circuit elements as well as the fastening means are advantageously made of metal or of some other suitable electrically conductive material. The fastening means are advantageously screws or bolts. The fastening to the rope is done by drilling bores in the rope and fastening with screws or bolts. The fastening means for attaching short circuit elements are advantageously the same screws or bolts used to attach the rope end block to the rope. Preferably said short circuit elements are metallic short circuit plates.

Preferably said wedge housing comprises two elongated side portions and two elongated wedge support portions, said side portions and said wedge support portions being one piece structure of predetermined size made from a hollow tube of round cross-section. Preferably said wedge housing element comprises one or more adjustable locking means which are arranged to lock said wedge elements in its position in said wedge housing. It is possible for the locking means to pass through the openings in the wedge housing support elements. The wedge housing is advantageously made of metal or of some other mechanically suitable material. The locking means are advantageously screws or bolts. Locking of the wedge elements is done by fastening with screws or bolts. Said rope terminal assembly is fixed to said fixing base with a fixing rod being fixed to said wedge housing side portions with fixing means. It is possible for the fixing means of the fixing rod to pass through the openings in the wedge housing side portions.

In a preferred embodiment of the rope terminal assembly of an elevator the light-weight rope comprises one or more, preferably at least four unidirectional carbon fiber-reinforced-polymer load-bearing parts covered with polyurethane coating. In case of four load-bearing parts, the rope is electrically modeled as four resistors. Preferred solution is to measure one rope as a single resistance. In that way measuring arrangements are kept simple and the method is also more reliable, because the number of wires and connections is minimized. With this method simple and reliable solutions to short-circuit carbon fiber-reinforced-polymer load-bearing parts, and to connect the measuring wires to the rope, preferably by self-tapping screws screwed between the load-bearing parts in such a way, that the screw acts as an electrically conductive path between adjacent load-bearing parts, are used. At the counterweight end of said rope, preferably three screws are used to short-circuit all of the strands. At the car end of said rope, preferably two outermost load-bearing parts are connected together, and measuring wires are inserted under these two screws with a split ring connector. With this arrangement, all carbon fiber-reinforced-polymer load-bearing parts are monitored and the whole rope is seen as a single resistor.

In an embodiment of a rope terminal assembly, an elevator is used to fix an elevator rope to a fixing base such as an elevator unit, which assembly comprises: an elevator rope, whose width is larger than its thickness in a rope transverse direction, with at least one end having an end face, a rope end block attached to the rope end, one wedge element, and a wedge housing. The rope terminal assembly comprises a rope gap through which said elevator rope passes and said wedge element is arranged to wedge between said rope and said wedge housing, preferably between said rope and the support side of said wedge housing, thus locking said elevator rope in the gap, and said rope end block is attached on said end face side of the elevator rope with respect to the wedge element.

In a preferred embodiment of the invention, at least one rope, but preferably a number of suspension and/or transmission ropes is constructed such that the width of the rope is larger than its thickness in a transverse direction of the rope and fitted to support and move an elevator car, said rope comprising a load-bearing part made of composite material, which composite material comprises reinforcing fibers, which preferably consist of unidirectional carbon fiber, in a polymer matrix. The suspension rope is most preferably secured by one end to the elevator car and by the other end to a counterweight, but it is applicable for use in elevators without counterweight as well. Although the figures only show elevators with a 1:1 suspension ratio, the rope described is also applicable for use as a suspension rope in an elevator with a 1:2 suspension ratio. The rope is particularly well suited for use as a suspension rope in an elevator having a large lifting height, preferably an elevator having a lifting height of over 100 meters, most preferably 150-800 meters. The rope defined can also be used to implement a new elevator without a compensating rope, or to convert an old elevator into one without a compensating rope.

It is obvious to a person skilled in the art that the invention is not exclusively limited to the embodiments described above, in which the invention has been described by way of example, but that many variations and different embodiments of the invention are possible within the scope of the inventive concept defined in the claims presented below. Thus it is obvious that the ropes described may be provided with a cogged surface or some other type of patterned surface to produce a positive contact with the traction sheave. It is also obvious that the rectangular composite load-bearing parts may comprise edges more starkly rounded than those illustrated or edges not rounded at all. Similarly, the polymer layer of the ropes may comprise edges/corners more starkly rounded than those illustrated or edges/corners not rounded at all. It is likewise obvious that the load-bearing part/parts in the embodiments can be arranged to cover most of the cross-section of the rope. In this case, the sheath-like polymer layer surrounding the load-bearing part/parts is made thinner as compared to the thickness of the load-bearing part, in the thickness-wise direction of the rope. It is likewise obvious that, in conjunction with the solutions represented, it is possible to use belts of other types than those presented. It is likewise obvious that both carbon fiber and glass fiber can be used in the same composite part if necessary. It is likewise obvious that the thickness of the polymer layer may be different from that described. It is likewise obvious that the shear-resistant part could be used as an additional component with any other rope structure showed in this application. It is likewise obvious that the matrix polymer in which the reinforcing fibers are distributed may comprise—mixed in the basic matrix polymer, such as e.g. epoxy—auxiliary materials, such as e.g. reinforcements, fillers, colors, fire retardants, stabilizers or corresponding agents. It is likewise obvious that, although the polymer matrix preferably does not consist of elastomer, the invention can also be utilized using an elastomer matrix. It is also obvious that the fibers need not necessarily be round in cross-section, but they may have some other cross-sectional shape. It is further obvious that auxiliary materials, such as e.g. reinforcements, fillers, colors, fire retardants, stabilizers or corresponding agents, may be mixed in the basic polymer of the layer, e.g. in polyurethane. It is likewise obvious that the invention can also be applied in elevators designed for hoisting heights other than those considered above.

The elevator as describe anywhere above is preferably, but not necessarily, installed inside a building. The car is preferably traveling vertically. The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

DETAILED DESCRIPTION

Figure 1:
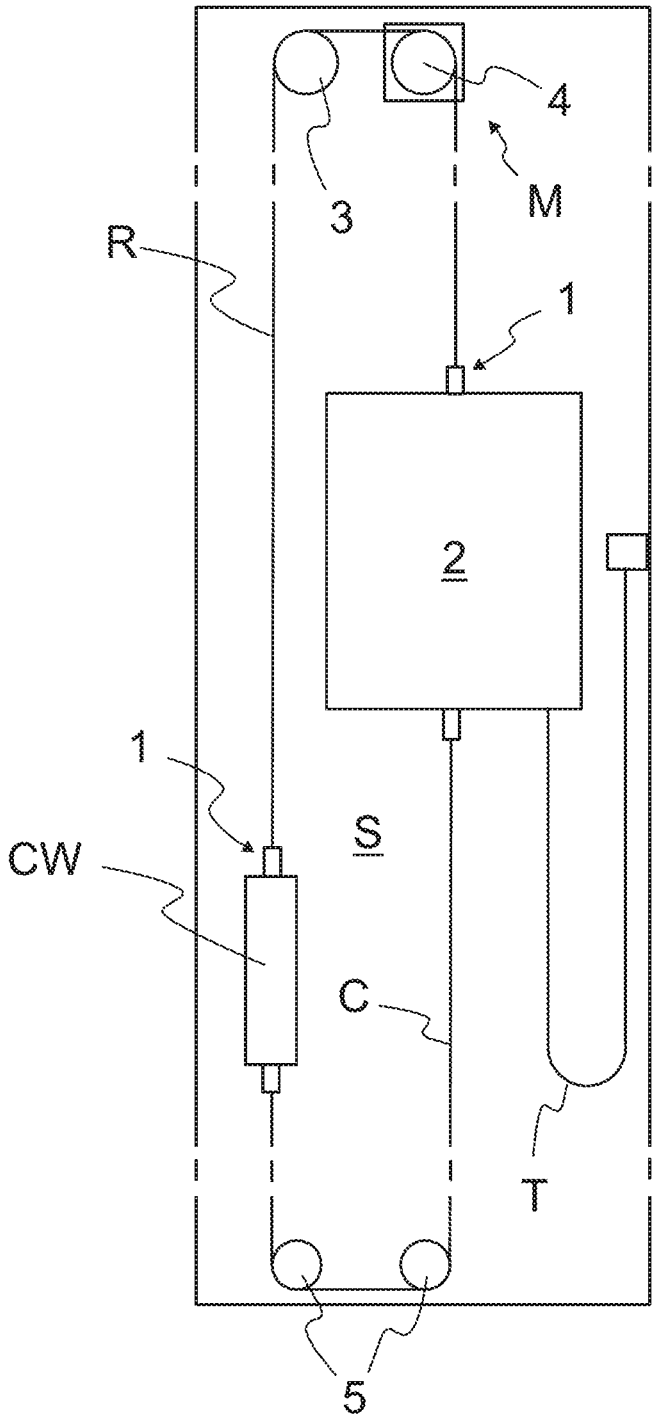
FIG. 1 illustrates schematically an elevator according to an embodiment of the invention.

In FIG. 1 it is illustrated a preferred embodiment of an elevator where the elevator rope R, C is connected to the elevator unit 2, CW with a rope terminal assembly 1 according to the invention. The elevator has been arranged to comprise a hoistway S, and an elevator unit 2 movable in the hoistway S, the elevator unit being an elevator car 2 for transporting passengers and/or goods. The elevator arrangement may also comprise other movable elevator units such as the counterweight CW, as depicted. The elevator comprises lifting means comprising a lifting device M, roping comprising one or more suspension and transmission ropes R, each said rope R comprising one or more load bearing members 10*a*-*d*, 11*a*-*b*, 12, and being attached with the rope terminal assembly 1 at least to one elevator unit 2, CW. Each rope R is guided to pass over the traction sheave 4 rotated by the hoisting machine M of the elevator and one ore more diverting pulleys 3. As the hoisting machine M rotates, the traction sheave 4 at the same time moves the elevator car 2 and the counterweight CW in the up direction and down direction, respectively, due to friction. In addition, in high-rise buildings and in high-speed elevators there is a second roping comprising one or more a compensating ropes C, each compensating rope C being suspended to hang at its first end to the bottom end of the counterweight CW and at its second end to the bottom part of the elevator car 2, either to the car sling or to the car itself. The compensating rope C is kept taut, e.g. by means of compensating pulleys 5, under which the compensating rope C passes around and which pulleys 5 are connected to a support structure on the base of the elevator hoistway S, which support structure is not, however, shown in the figure. A travelling cable T intended for the electricity supply of the elevator car and/or for data traffic, e.g., rope condition monitoring data, is suspended to hang at its first end to the elevator car 2, e.g. to the bottom part of the elevator car 2, and at its second end to a connection point on the wall of the elevator hoistway S, which connection point is typically at the point of the midpoint or above the midpoint of the height direction of the elevator hoistway S.

Figures 2A, 2B, 2C:
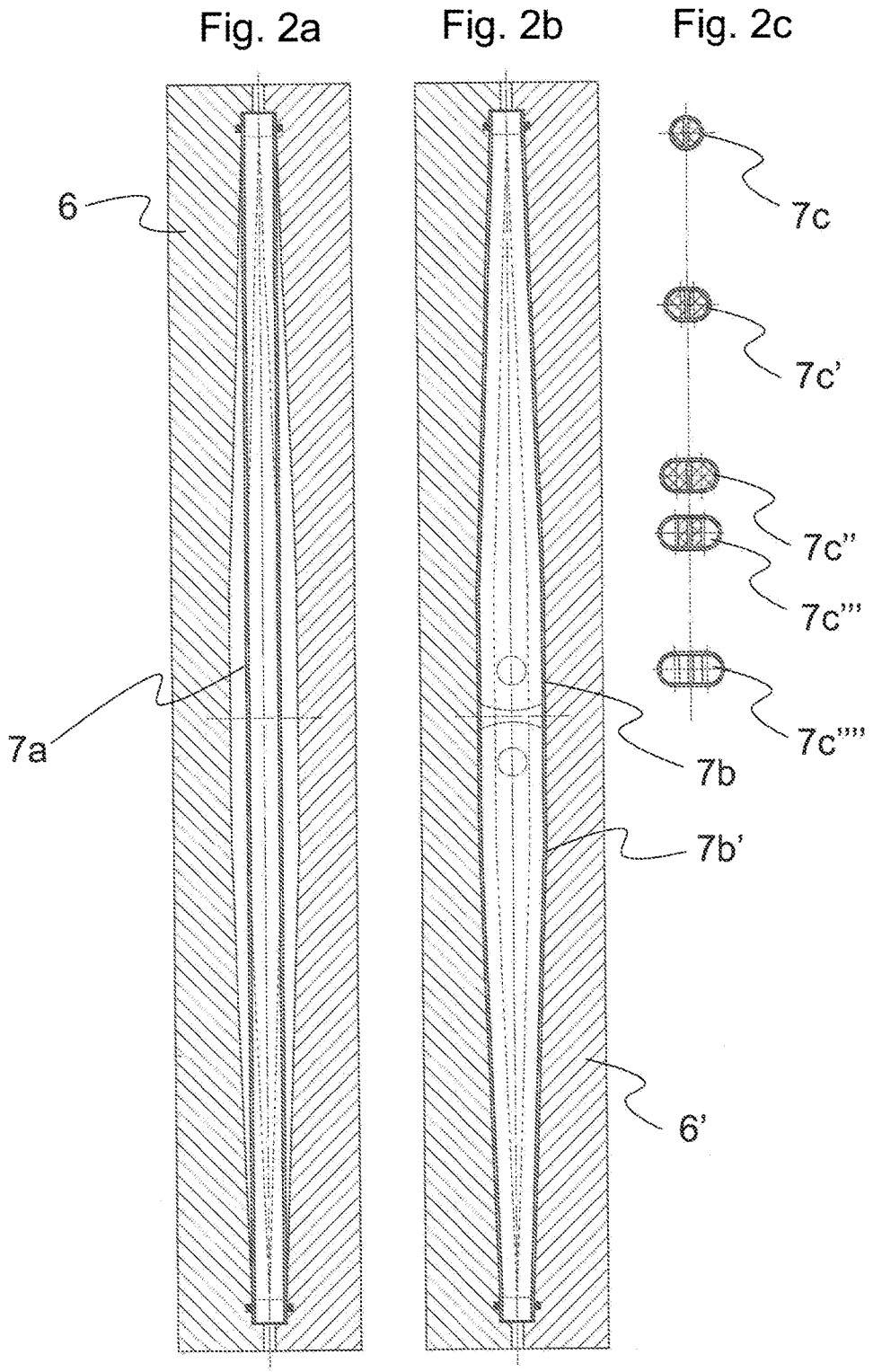
FIG. 2*a* illustrates a preferred embodiment of a hollow tube placed inside a negative mold that has the shape of the wedge housing.
FIG. 2*b* illustrates a preferred embodiment of a hollow tube placed inside a negative mold that has been hydroformed to the shape of the wedge housing.
FIG. 2*c* illustrates cross-sections of a preferred embodiment of the hydroformed wedge housing.

FIG. 2*a*-2*c* illustrates a preferred embodiment of said wedge housing 7 being a one piece structure of predetermined size made from a hollow tube 7*a* of round cross-section. To hydroform a metallic hollow tube 7*a* into the wedge housing shape, a hollow tube 7*a* of preferably ductile metal such as aluminum, brass, low alloy steels, stainless steel is placed inside a negative mold 6, 6' that has the shape of the wedge housing. High pressure hydraulic pumps are then used to inject fluid at very high pressure inside the aluminum which causes it to expand until it matches the mold. The hydroformed aluminum wedge housing 7*b*, 7*b*' is then removed from the mold. Hydroforming allows complex shapes with concavities to be formed, which would be difficult or impossible with standard solid die stamping. Hydroformed wedge housing 7 can hence be made with a higher stiffness-to-weight ratio and at a lower per unit cost than traditional stamped or stamped and welded wedge housing. As shown in FIG. 2*a*, a hollow tube 7*a* of preferably ductile metal is placed inside a negative mold 6, 6' that has the shape of the wedge housing. As shown in FIG. 2*b*, using symmetrical mold 6, 6' in wedge housing lengthwise direction, two pieces of wedge housing 7*b*, 7*b*' are manufactured simultaneously in the mold 6, 6' by cutting the one hydroformed piece in half for two pieces of wedge housing 7*b*, 7*b*'. FIG. 2*c* illustrates the round-shaped cross-sections 7*c*, 7*c*', 7*c*'', 7*c*''', 7*c*'''' of the hydroformed wedge housing 7*b*, 7*b*' at different points of the longitudinal direction of the wedge housing 7*b*, 7*b*'.

Figures 3A, 3B, 3C:
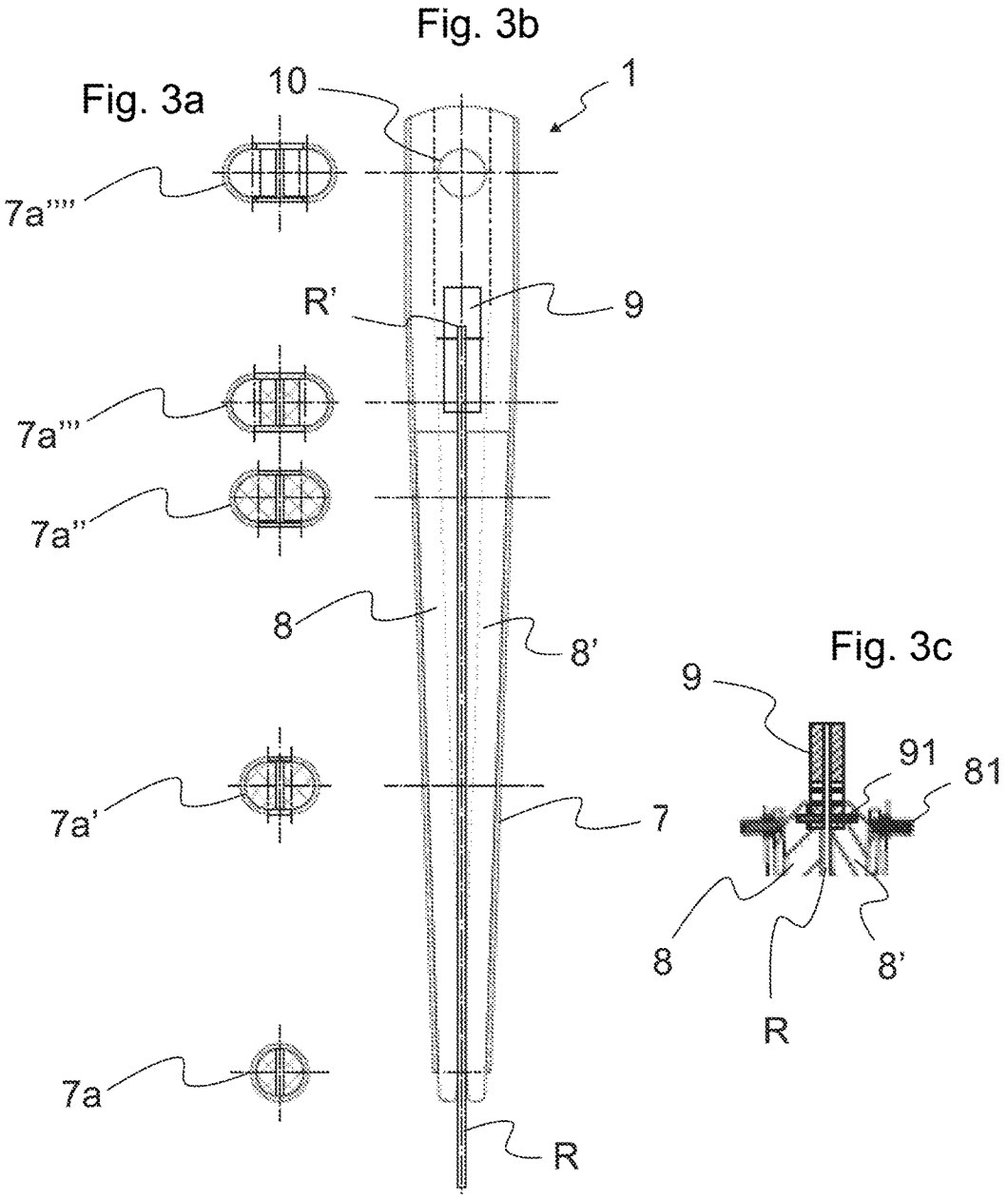
FIG. 3*a* illustrates cross-sections of a preferred embodiment of the rope terminal assembly with two wedge elements.
FIG. 3*b* illustrates a side view of a preferred embodiment of the rope terminal assembly with two wedge elements.
FIG. 3*c* illustrates an embodiment of the rope end block.

FIG. 3*a*-3*c* illustrates a preferred embodiment of a rope terminal assembly 1 of an elevator fixing an elevator rope R to a fixing base such as an elevator unit 2, CW, which rope terminal assembly 1 comprises an elevator rope R, whose width is larger than its thickness in a rope transverse direction, with at least one end having an end face R', a rope end block 9 attached to the rope end, two wedge elements 8, 8', a wedge housing 4. The rope terminal assembly 1 comprises a rope gap through which said elevator rope R passes and said wedge element 8, 8' is arranged to wedge between said rope R and said wedge housing 7, preferably between said rope R and the supporting portions of said wedge housing 7, thus locking said elevator rope in the gap, and said rope end block 9 is attached on said end face R' side of the elevator rope R with respect to the wedge element 8, 8'. FIG. 3*a* illustrates the round-shaped cross-sections 7*a*, 7*a*', 7*a*", 7*a*"', 7*a*"" of the rope terminal assembly 1 with two wedge elements at different points of the longitudinal direction of the wedge housing 7 and FIG. 3*b* the side view of the rope terminal assembly 1 with two wedge elements.

Figure 3D:
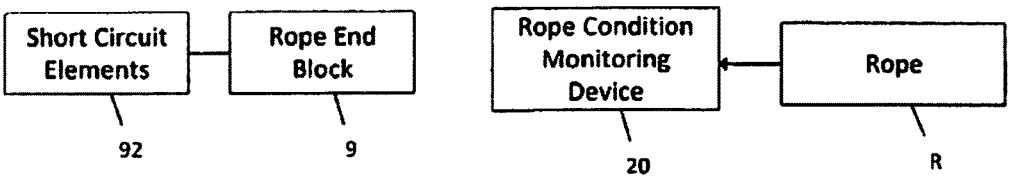
FIG. 3*d* illustrates an embodiment of the rope end block and the rope condition monitoring device.

FIG. 3*c* illustrates an embodiment of the rope end block 9 attached to said elevator rope R end with fastening means 91 and FIG. 3*d* illustrates an embodiment of short circuit elements 92 connected to the rope end block 9. It is thus possible for the fastening means 91 to pass through the openings in the frame portion of the rope end block 9. The fastening means 91 can advantageously be made of metal or of some other suitable electrically conductive material. The fastening means 91 are advantageously screws or bolts with nuts. The fastening to the rope can be done by drilling bores in the rope R and fastening with screws or bolts. Elasticity of said rope end block 9 can also be arranged by sizing and designing the openings of the frame portion of the rope end block 9 to have an oval shape, for instance. The rope end block 9 comprises one or more short circuit elements 92 attached to the rope end block 9 with fastening means. It is thus possible for the fastening means to pass through the openings in the short circuit elements. The short circuit elements 92 such as short circuit plates as well as the fastening means are advantageously made of metal or of some other suitable electrically conductive material. Rope end block 9 is manufactured from plastics or some other electrically non-conductive material. Preferably rope end block 9 is a single piece structure manufactured from plastics, preferably from thermoplastics polymer or thermosetting polymer.

Said wedge housing 7 may comprise hollows and one or more adjustable locking means 81 which are arranged to lock said wedge elements 8, 8' in its position in said wedge housing element. It is possible for the locking means 81 to pass through the openings in the wedge housing element 7. The locking means 81 are advantageously screws or bolts. Locking of the wedge elements is done by fastening with screws or bolts. Said rope terminal assembly 1 is fixed to said fixing base with a fixing rod being fixed to said side of the wedge housing 7 with fixing means. It is possible for the fixing means of the fixing rod to pass through the openings 10 in the wedge housing 7.

FIG. 3*d* also illustrates a rope condition monitoring device (or, alternatively, rope condition monitoring means) 20 connected to the rope D. The elevator comprises rope condition monitoring means comprising the rope condition monitoring device 20, which monitors and transmits an electrical signal of said elevator rope R, C, at predefined time intervals, preferably at least once per second, to an elevator controller. If an error signal is transmitted from said rope condition monitoring means to an elevator controller, the elevator operation is altered or the elevator is taken out of service. Preferably the rope condition monitoring means is used to measure electrical resistance between a first point and a second point of said elevator rope R, C first time during elevator installation and second time when said elevator is used for transporting passenger and/or goods. Preferably said first point and second point are points of a non-metallic load bearing part 11*a-d*, 12*a-b*, 13 of the elevator rope R, C, or points of several electrically connected non-metallic load bearing parts 11*a-d*, 12*a-b*, 13 of said elevator rope R, C.

Preferably said wedge element 8, 8' is an elongated element comprising a smooth contact surface portion and a rough or patterned contact surface portion, said smooth contact surface portion being arranged against said wedge housing 7 and said rough or patterned contact surface being arranged against said elevator rope R surface. The wedge element 8, 8' may also comprise a space for the rope end block 9 at the first end of the wedge element 8, 8'. It is thus possible for the fastening means 91 of the rope end block 9 to be attached to the space of the wedge element 8, 8'. The space for the rope end block 9 is advantageously on the rough or patterned contact surface portion side of the first end of the wedge element 8, 8' and comprises a threaded opening for the fastening means 91. The wedge element 8, 8' is advantageously made of metal or of some other mechanically suitable material.

Figure 4A:
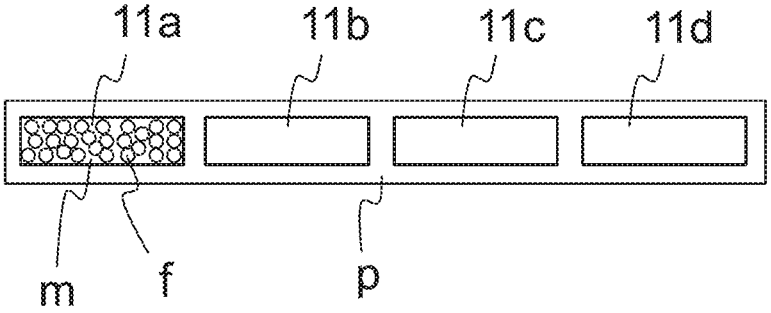
FIGS. 4*a*-4*c* illustrates the preferred alternative cross-sections for the elevator rope.
Figure 4B:
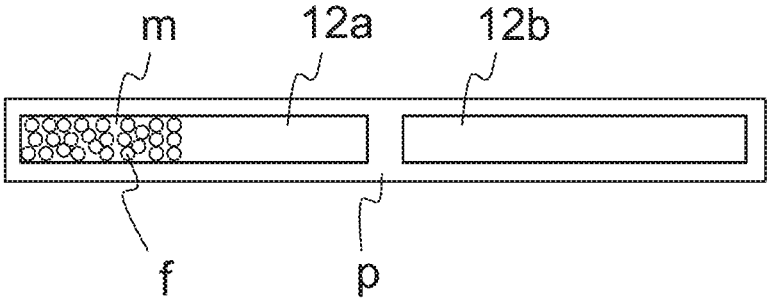
Figure 4C:
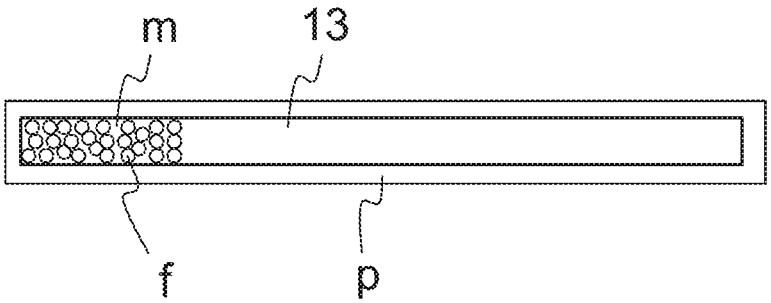

FIGS. 4*a*, 4*b* and 4*c* illustrates a preferred embodiment of a rope R cross section with four load-bearing parts 11*a-d*, two load-bearing parts 12*a-b*, and one load-bearing part 13, respectively, as described in connection with one of FIGS. 1 and 3 used as a suspension and/or transmission rope R of an elevator, particularly a passenger elevator. In the use according to the invention, at least one rope R, but preferably a number of ropes R is constructed such that the width of the rope is larger than its thickness in a transverse direction of the rope R and fitted to support and move an elevator car, said rope R comprising a load-bearing part 11*a-d*, 12*a-b*, 13 made of composite material, which composite material comprises reinforcing fibers f, which consist of untwisted unidirectional carbon fibers, in a polymer matrix m oriented in the lengthwise direction of the rope. The suspension rope R is most preferably secured by one end to the elevator car 1 and by the other end to a counterweight CW, but it is applicable for use in elevators without counterweight as well. Although the figures only show elevators with a 1:1 suspension ratio, the rope R described is also applicable for use as a suspension rope R in an elevator with a 1:2 suspension ratio. The rope R is particularly well suited for use as a suspension and transmission rope R in an elevator having a large lifting height, preferably an elevator having a lifting height of over 100 meters, most preferably 150-800 meters. The rope R defined can also be used to implement a new elevator without a compensating rope C, or to convert an old elevator into one without a compensating rope C.

As presented in the FIGS. 4*a*-4*c*, the rope R is in the form of a belt, and thereby has a width substantially larger than the thickness thereof. This makes it well suitable for elevator use as bending of the rope is necessary in most elevators. So as to enable turning radius well suitable for elevator use, it is preferable that the width/thickness ratio of the rope is at least 2 or more, preferably at least 4, even more preferably at least 5 or more. So as to enable turning radius well suitable for elevator use, it is preferable that the width/thickness ratio(s) of said force transmission part(s) is/are at least 2, preferably at least 3 or more. When the rope R is made to contain only one load bearing member 13, then it is preferable that the ratio is 5 or more. It is preferable, that all the load bearing member(s) 11*a-d*, 12*a-b*, 13 of the rope R (irrespective whether there is only one or more of them in the rope) cover together majority, preferably 70% or over, more preferably 75% or over, most preferably 80% or over, of the width of the rope. Thus, the width of the rope is effectively utilized for the function of load bearing.

In the embodiment as illustrated in FIG. 4*a* and FIG. 4*b*, the rope R comprises a plurality of load bearing members 11*a-d*, 12*a-b*. These plural load bearing members 11*a-d*, 12*a-b* are placed adjacent each other in the width direction of the belt and on the same plane. In the embodiment as illustrated in FIG. 4*c*, the rope R comprises only one load bearing member 13. In both of these embodiments, the load bearing member(s) 11*a-d*, 12*a-b*, 13 is/are surrounded with a layer p, which layer p forms the surface of the rope protecting the load bearing member(s) 11*a-d*, 12*a-b*, 13. The layer p is preferably of polymer, most preferably of elastic polymer, such as of polyurethane, as it provides good wear resistance, protection and good friction properties, for instance for frictional traction contact with the rope wheel 4. In both of these embodiments, the load bearing member(s) 11*a-d*, 12*a-b*, 13 have a width larger than the thickness thereof as measured in width-direction of the rope R.

In this application, the term load bearing member of a rope refers to the part that is elongated in the longitudinal direction of the rope, and which part is able to bear without breaking a significant part of the load exerted on the rope in question in the longitudinal direction of the rope. The aforementioned load exerted on the rope causes tension on the load bearing member in the longitudinal direction of the load bearing member, which tension can be transmitted inside the load bearing member in question all the length of the load bearing member, e.g. from one end of the load bearing member to the other end of it.

It is obvious to a person skilled in the art that the invention is not exclusively limited to the embodiments described above, in which the invention has been described by way of example, but that many variations and different embodiments of the invention are possible within the scope of the inventive concept defined in the claims presented below. Thus it is obvious that the ropes R described may be provided with a cogged surface or some other type of patterned surface to produce a positive contact with the traction sheave 4. It is also obvious that the rectangular composite load-bearing parts 11*a-d*, 12*a-b*, and 13 may comprise edges more starkly rounded than those illustrated or edges not rounded at all. Similarly, the polymer layer p of the ropes R may comprise edges/corners more starkly rounded than those illustrated or edges/corners not rounded at all. It is likewise obvious that the load-bearing part/parts 11*a-d*, 12*a-b*, and 13 in the embodiments can be arranged to cover most of the cross-section of the rope R. In this case, the sheath-like polymer layer p surrounding the load-bearing part/parts 11*a-d*, 12*a-b*, and 13 is made thinner as compared to the thickness of the load-bearing part 11*a-d*, 12*a-b*, and 13 in the thickness-wise direction of the rope R. It is likewise obvious that, in conjunction with the solutions represented by figures, it is possible to use belts of other types than those presented. It is likewise obvious that both carbon fiber and glass fiber can be used in the same composite part if necessary. It is likewise obvious that the thickness of the polymer p layer may be different from that described. It is likewise obvious that the shear-resistant part could be used as an additional component with any other rope structure showed in this application. It is likewise obvious that the matrix polymer in which the reinforcing fibers f are distributed may comprise—mixed in the basic matrix polymer, such as e.g. epoxy—auxiliary materials, such as e.g. reinforcements, fillers, colors, fire retardants, stabilizers or corresponding agents. It is likewise obvious that, although the polymer matrix preferably does not consist of elastomer, the invention can also be utilized using an elastomer matrix. It is also obvious that the fibers f need not necessarily be round in cross-section, but they may have some other cross-sectional shape. It is further obvious that auxiliary materials, such as e.g. reinforcements, fillers, colors, fire retardants, stabilizers or corresponding agents, may be mixed in the basic polymer of the layer p, e.g. in polyurethane. It is likewise obvious that the invention can also be applied in elevators designed for hoisting heights other than those considered above.

It is to be understood that the above description and the accompanying figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. A rope terminal assembly configured to fix an elevator rope to an elevator unit, the rope terminal assembly comprising:

a wedge housing having a one-piece structure with a round shaped cross-section that gradually decreases in diameter from a first end of the wedge housing to a second end of the wedge housing; and a pair of elongated wedge elements having a diameter that gradually decreases from a first end of the pair of elongated wedge elements to a second end of the pair of elongated wedge elements, the pair of elongated wedge elements including a first wedge element and a second wedge element having a rope gap therebetween through which the elevator rope passes such that the pair of elongated wedge elements wedge between the elevator rope and the wedge housing to lock the elevator rope in the rope gap between the first wedge element and the second wedge element, the first wedge element and the second wedge element being elongated elements, the elevator rope having a width and a thickness, the width of the elevator rope being larger than the thickness of the elevator rope such that the elevator rope is belt shaped.

2. The rope terminal assembly according to claim 1, wherein the one piece structure of the wedge housing is made of a metallic hollow tube with the round shaped cross-section.

3. The rope terminal assembly according to claim 2, wherein the one piece structure of the wedge housing is made of the metallic hollow tube through tube hydroforming.

4. The rope terminal assembly according to claim 1, further comprising:

a rope end block attached to a rope end face of the elevator rope, the rope end block configured to configured to push the pair of elongated wedge elements more tightly between the elevator rope and the wedge housing, when the elevator rope slits in the rope gap.

5. The rope terminal assembly according to claim 4, wherein the rope end block includes a first portion on a first side surface of one end of the elevator rope and a second portion on a second side surface of the one end of the elevator rope.

6. The rope terminal assembly according to claim 5, wherein the rope end block is a single piece structure such that the first portion and the second portion of the rope end block are connected via a middle part of the rope end block.

7. The rope terminal assembly according to claim 4, wherein the rope end block extends over the rope end face of the elevator rope.

8. The rope terminal assembly according to claim 1, wherein the pair of wedge elements include a non-patterned contact surface portion and a patterned contact surface portion, the non-patterned contact surface portion is arranged against the wedge housing and the patterned contact surface portion is arranged against the elevator rope.

9. The rope terminal assembly according to claim 1, wherein the wedge housing comprises:

one or more adjustable locking devices configured to lock the pair of elongated wedge elements in the wedge housing.

10. The rope terminal assembly according to claim 1, wherein the rope end block is attached to the rope end face with one or more fastening devices.

11. The rope terminal assembly according to claim 1, wherein the rope end block is electrically non-conductive.

12. The rope terminal assembly according to claim 1, wherein the elevator rope is electrically connected to a rope condition monitoring device via the rope end block, the rope end block including one or more electrically conductive short circuit elements and fastening devices.

13. The rope terminal assembly according to claim 12, wherein the elevator rope includes a non-metallic material such as carbon-fiber-reinforced polymer load bearing parts to which the rope condition monitoring device is connected with electrically conductive fasteners.

14. The rope terminal assembly according to claim 1, wherein the elevator rope is made of a non-metallic material such as carbon-fiber-reinforced polymer composite material.

15. An elevator comprising:

the elevator unit movable in a hoistway, a lifting device; and the elevator rope connected to the elevator unit via the rope terminal assembly according to claim 1.

* * * * *